US005671874A

United States Patent [19]

Behar et al.

[11] Patent Number: 5,671,874

[45] Date of Patent: Sep. 30, 1997

[54] MINIATURE DISPENSER PUMP AND OUTLET VALVE FOR SAME

[75] Inventors: Alain Behar, Suresves; Marcel Eudes, Le Mesnil-le-Roi, both of France

[73] Assignee: Sofab, France

[21] Appl. No.: 544,717

[22] Filed: Oct. 18, 1995

[30] Foreign Application Priority Data

Oct. 19, 1994 [FR] France ..... 94 12460

[51] Int. Cl.[6] ..... B67D 5/40

[52] U.S. Cl. ..... 222/341; 222/385

[58] Field of Search ..... 222/321.2, 321.7, 222/321.9, 341, 382, 383.1, 385; 239/333

[56] References Cited

U.S. PATENT DOCUMENTS

| | | | |
|---|---|---|---|
| 3,257,961 | 6/1966 | Schlenker | 222/321.9 |
| 3,583,605 | 6/1971 | Corsette | 222/321.9 |
| 4,154,374 | 5/1979 | Kirk, Jr. | 222/321.2 |
| 4,252,507 | 2/1981 | Knickerbocker | 222/321.2 |
| 4,434,916 | 3/1984 | Ruscitti et al. | 222/385 |
| 4,607,765 | 8/1986 | Ruscitti | 222/321.9 |
| 4,941,595 | 7/1990 | Montaner et al. | 222/321.2 |

FOREIGN PATENT DOCUMENTS 0 536 617 4/1993 European Pat. Off. .

*Primary Examiner*—Philippe Derakshani
*Attorney, Agent, or Firm*—Bacon & Thomas

[57] ABSTRACT

The invention provides a miniature pump for substances such as cosmetics or pharmaceuticals. The pump comprises a cylindrical body with a bottom intake provided with an inlet valve, in which a skirt encloses a movable piston against the action of a return spring, the piston being provided with a nozzle which passes through the skirt and having an axial channel closed by an internal valve member, biased by a spring. The nozzle is provided at its top portion with an internal shoulder, its bottom portion widening out by contrast into a collar, onto which a bushing is forced by its top edge, the bushing acting externally as a piston sealing gasket, defining under the collar of the nozzle an internal chamber in which the outlet valve member is located, its base being pierced by an axial orifice which acts as an annular seat for the valve member, the return spring for the valve member and the valve member itself being introduced from below and placed inside the nozzle. This pump provides excellent spraying.

9 Claims, 2 Drawing Sheets

MINIATURE DISPENSER PUMP AND OUTLET VALVE FOR SAME

Numerous types of miniature pump have been proposed for fitting to the containers of cosmetics or pharmaceuticals to allow them to be dispensed conveniently in successive measured quantities. These pumps are usually smaller than a cubic centimeter in size.

BACKGROUND OF THE INVENTION

The majority of these pumps comprise a cylindrical body having a bottom intake fitted with an inlet valve, in particular of the type having a ball which falls back under its own weight, and in which a skirt encloses a piston which moves against the action of a return spring; the piston has a hollow control stem which passes through the skirt and forms an outlet duct or nozzle having an internal axial channel Which is closed by an outlet valve that is biased by means of a resilient return member, the piston stem carrying a push-button which normally also carries the discharge nozzle for the substance.

Due to the extreme miniaturization of the parts, a difficulty arises in obtaining a discharge that is steady and precise, particularly when spraying is required. The simplest and most well-established techniques propose using an outlet valve with an internal valve member, connected by its top part within the piston stem. The small available cross-section makes it necessary to use very weak return springs, and for some time it has been preferred to use an external sleeve combining the functions of valve member and of gasket for sealing between the piston and the body. In order to have an operation that is more steady, this valve member may advantageously operate as a slider, opening only after a certain amount of dead stroke; however, the expectations of the designers are somewhat thwarted by the behavior of users who are surprised by the resulting impression of double action.

OBJECT AND SUMMARY OF THE INVENTION

The aim of the invention is to provide a better compromise between smoothness and accuracy, based on the fact that improvements in manufacturing techniques and in particular in the accuracy with which parts are now made make it possible, once again, to use an internal valve member while nevertheless eliminating both its past drawbacks and the impression of double action created by excessive dead stroke.

According to the invention, the piston is formed in two parts comprising a nozzle which is provided at its top portion with an internal shoulder, its bottom portion widening out by contrast into a collar, and also comprising a bushing which is forced by its top edge onto the collar and which acts externally as a sealing gasket and defines an internal chamber in which the outlet valve member is located. The base of the outlet valve is cup-shaped with a sloping sidewall and a bottom that intersects an axially extending orifice. An annular area on the bottom of the cup and the cup sidewall constitutes a valve seat or seating for the outlet valve member adjacent the orifice. The return spring for the valve member and the valve member itself are inserted upwardly into the nozzle from below.

The cup bottom is connected via a rounded fillet to an outwardly sloping ring that constitute the sidewalls. The outlet valve member is bell-shaped with a downwardly-turned distal lip that is thin, the perimeter length of which lip in the relaxed state is substantially equal to or slightly greater than that of the fillet. The outlet valve member lip, under the influence of the return spring, bears against and is sealingly compressed and applied onto the sidewall and bottom of the cup. The active surface of the outlet valve member is therefore at a minimum in the sealed position. The curvature of the distal edge of the outlet valve lip is preferably great than that of the fillet.

When the user presses the push-button, the inlet valve closes; pressure in the pump increases and initially presses the lip of the outlet valve against the sloping side of the cup, increasing its sealing; beyond a certain threshold, it tends to lift the outlet valve member, pushing the distal end of the valve sealing lip into the sidewall of the cup; this effect causes a significantly greater surface area of the valve member to be subjected to the pressure, because of the small dimensions of the pump, so that its return spring yields rapidly.

The limited resilience of the lip of the valve member allows it to expand and follow the widened sidewall of the cup over a very small distance only, less than the total height of the sidewall ring. As soon as it loses contact with the wall, it returns to its initial perimeter length (and diameter) since the major portion of the pressure is transmitted to the discharge nozzle, and the valve member tends to move back down again, leaving the flow of substance along the oblique ring with a narrow lateral passage of cross-section that varies with its residual lift; this passage is preceded by a convergent portion which offsets headlosses downstream, while centering the outlet valve member and stabilizing both its position and the pressure available at the nozzle orifice.

Because the valve member is placed in the enlarged chamber formed by the bushing under the collar of the nozzle, it is possible to have a minimum effective cross-sectional area, at rest, which is not less than that of the channel in the nozzle, and on lifting, a maximum cross-sectional area which is at least twice the size, and of the order of one third or at least one fourth of the cross-sectional area of the piston in the pump body, so that it is possible to provide the outlet valve with a reasonably strong spring. The flaring of the ring minimizes the effects of friction which are hard to control and the displacement of the piston that is required for opening the valve member is about three times smaller than its own displacement, i.e. almost negligible.

This construction results in a smoothness of operation which avoids detrimental reactions on the part of the user and which allows very steady spraying if required.

The total height of the cup of the valve seat should not be greater than the lift of the valve member, i.e. a few tenths of a millimeter, for an average slope of the widened portion of the cup area of about 0.3 and preferably increasing from its point of connection to the fillet towards the top, so as to give an S-shape to the cup wall. The small available lateral space, and the need to reduce dead volumes and to avoid sudden variations in flow cross-sections advantageously results in the ring being placed substantially directly below the lateral wall of the chamber above the seating, which is also circular, to form a flow channel which flares upwards slightly.

BRIEF DESCRIPTION OF THE DRAWINGS

Other features of the invention become apparent from the following description of an advantageous example, given with reference to the accompanying drawings. These show.

MORE DETAILED DESCRIPTION

Figure 1:
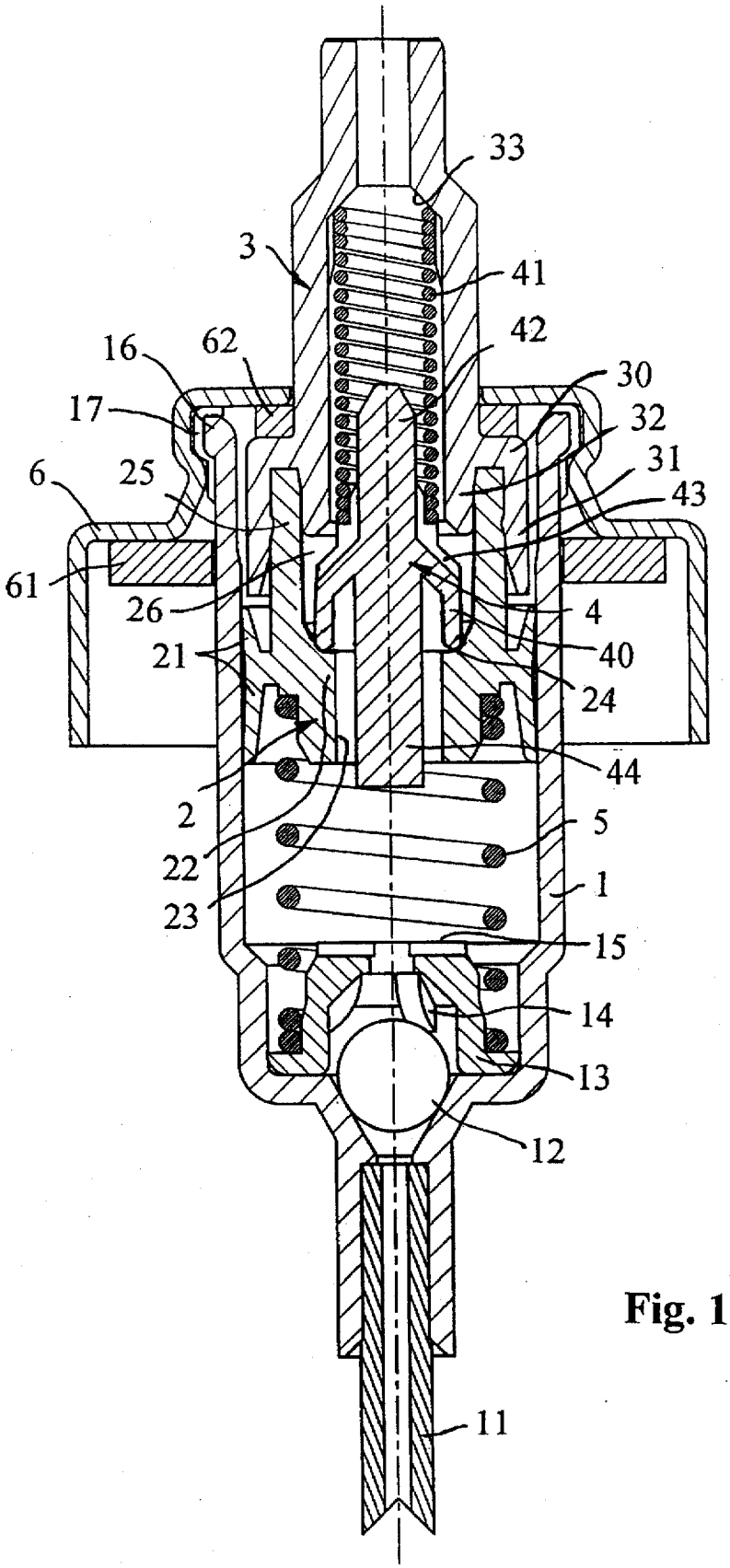
FIG. 1: a section through an entire pump of the invention.

The pump of FIG. 1 has a body 1 provided with a bottom intake provided with an intake tube 11 and controlled by an inlet valve, having a ball 12 as its valve member, which ball is held captive by a cage 13 with internal stops 14, and by a top seat 15 having radial grooves.

The piston is constituted by a bushing 2 assembled onto a hollow stem 3.

The side wall of the bushing 2 seals against the pump body via two flexible lips 21 which are directed in opposite directions, and its base 22 which is pierced by an axial orifice 23 forms an annular seat 24 on its top surface, this seat being cup-shaped with a flared ring.

At its bottom end, the hollow stem 3 carries a collar 30 which, in the example shown, is formed of two concentric flanges 31 and 32 which are separated by a groove which receives the top edge 25 of the bushing. This stem forms a nozzle with an internal shoulder 33, its top end tapering externally to a standard diameter which allows engagement with a push-button of current type (not shown), generally provided with a spray nozzle.

Inside and towards the bottom of the bushing 2, below the collar 30, the base 22 defines an outlet valve chamber 26 which receives an outlet valve 4 which is bell-shaped with a downwardly-turned sealing distal lip 40. A return spring 41 placed from below in the internal channel of the stem or nozzle 3 bears against its shoulder 33 and presses the bell 40 against a valve seating bottom of the cup 24 situated on the top surface of the base 22 and which forms the lower portion of chamber 26.

A spring 5, compressed between two opposed seats on the cage 13 and the bushing 2, returns the piston back upwards. A skirt 6 confines this entire mechanism within the body of the pump and allows the nozzle 3 to pass through. In FIG. 1, this is done by means of a metal washer crimped onto the rim 16 of the body; the washer is then crimped a second time by the packager, its gasket 61 being tightly pinched against a flask (not shown) containing the substance.

The spring 5 presses the piston against the skirt 6; in the example shown, the internal clearance left by the gasket 61 and the grooves 17 in the rim 16 of the body 1 form a vent between the receptacle and the outside atmosphere along the nozzle 3; it is the shoulder formed by the collar 30 of the nozzle which sealingly engages against a gasket 62; operating the push-button opens communication therealong so as to put the pressure back into equilibrium.

It will be noted that the valve member has two opposed axial spindles which make it easier to mount.

The top spindle 42 reduces the dead volumes and guides the spring 41; at its root, a seat 43 supports the spring, this seat preferably being grooved so as also to facilitate passage of the substance; the seat may act as a stop. At the bottom end of the stroke of the piston, just before the base 22, the bottom spindle 44 abuts the seat 15 of the cage 13 in conventional manner so as to force the valve member 4 to open to facilitate priming on first use, return of the piston to its rest position then causing the substance to be drawn in once the spring 41, now released again, has re-closed the outlet.

Figure 2:
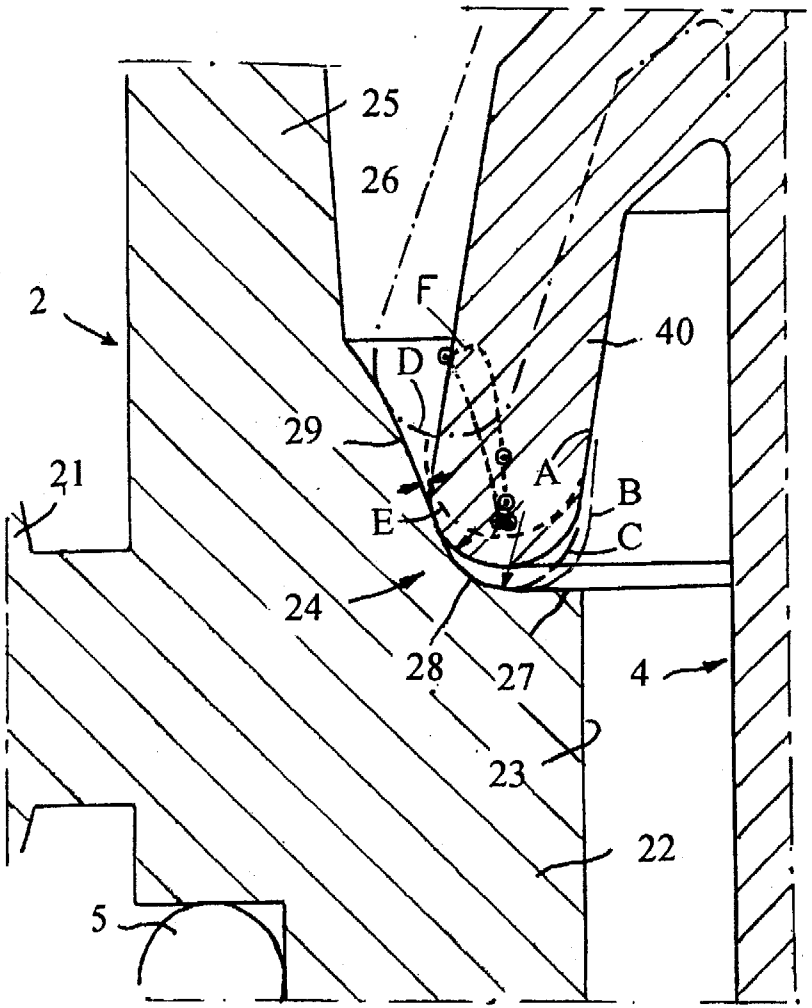
FIG. 2: a detail of the outlet valve showing the profiles of its cup-shaped seat and the lip of its valve member.

The structure of the outlet valve is seen more clearly in FIG. 2 which, enlarged to seventy times life size, allows its operation to be understood.

On the base 22 of bushing 2, around the orifice 23 of diameter 1.6 mm, valve seating cup 24 defines a bottom having a narrow annular radial valve seat surface 27 and a sidewall including a fillet 28 of radius 0.2 mm defining a torus having an average diameter of 2 mm connected with an outwardly sloping or flared ring 29, the outline of which is in the form of an arc of a circle having a height 0.4 mm. The slope of this ring increases from 0.25 at the bottom to about 0.7 at the top. The distal lip 40 of the valve member 4 terminates in a semi-circular distal crest having a radius of 0.15 mm and defining a torus having an average diameter of 2.1 mm which in the released or relaxed state, touches a portion of the flared ring, with the center line in the position A as shown represented by a solid line. When the valve member 4 is at rest on the seating formed by the cup 24, the lip is compressed into a bottom position against the bottom of the cup as shown at B (as a broken line with long fine dashes), and lightly pressed into the sloping sidewall of the cup. When the pump is operated, the increase in pressure under the valve member forces it outwardly against the cup sidewall, into a position C (represented as a broken line with long thick dashes), slightly offset towards the outside.

When the return spring of the valve member begins to yield, the substance rapidly infiltrates under the lip, sealing holding good only up to the height of the cup ring; as a result, the force on the spring doubles and its resistance collapses completely. The lip 40 immediately rises up along the cup sidewall but its elasticity only allows it to follow the wall up to a position D (shown as a dot-dashed line), its stroke only reaching 0.4 mm which, neglecting elasticity effects, corresponds to a piston stroke of the order of 0.1 mm only.

The lip 40 then lifts off the sidewall so that the valve allows the flow to pass; given the small size of the dead volumes, the fall in pressure reaches an equilibrium between the orifice which it has just opened and that of the spray nozzle, so that the lip contracts again and the valve member falls back down to an equilibrium position E (represented by a dotted line) leaving a narrow throat opposite the sidewall ring 29, the flow converging towards the throat and then progressively diverging. After use, the valve remains open under the force of the spindle 44 and does not return to the position B until the user releases the applied force. The trajectory within the cup 24 is a cycle which is represented by dotted line F.

Figure 3:
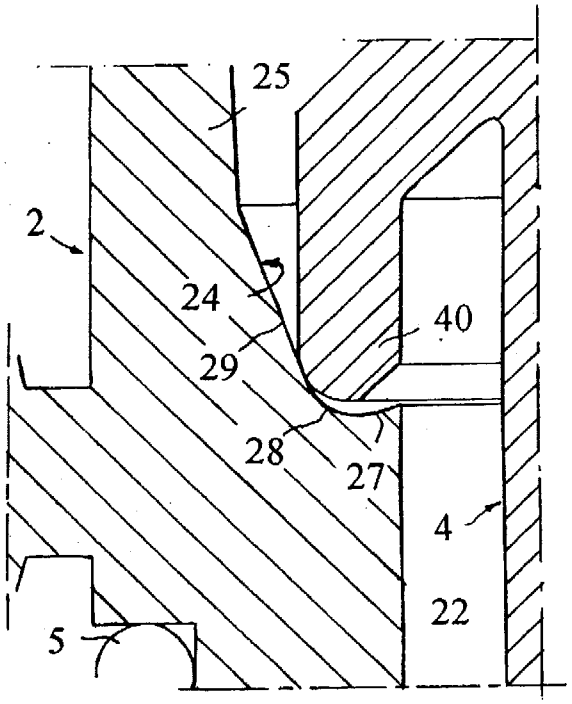
FIG. 3: a detail of a variant of the outlet valve.

FIG. 3 shows an example of an acceptable variant, in which the cup ring 29 has a constant slope of 0.3 mm and the seating 27 has a conical shape approaching orifice 23 which increases the contact surface at rest, this being compensated by a reduced inside angle on the edge of the lip 40. This gives a slightly higher valve lift but also allows a gentle operation and a very steady spraying.

I claim:

1. A miniature dispenser pump comprising a cylindrical body with a bottom intake provided with an inlet valve, in which body a skirt is provided and encloses a movable piston against the action of a return spring, the piston being provided with a nozzle which passes upwardly through the skirt, an axial channel; and an internal outlet valve member closing the channel, a return spring biasing the outlet valve member toward a closed position; wherein the nozzle is provided at its top portion with an internal shoulder, its bottom portion widening out into a collar, onto which a bushing is forced by its top edge, the bushing being formed to act externally as a piston sealing gasket, defining under the collar of the nozzle an internal chamber in which the outlet valve member is located; the chamber having a base intersecting an axial orifice; an annular seat for said outlet valve member in the base around the orifice; the return spring for the outlet valve member and the outlet valve member itself extending from below upwardly into the nozzle.

2. A pump according to claim 1, wherein the outlet valve member has a minimum effective cross-sectional area not less than that of the channel of the nozzle, and a maximum effective cross-sectional area which is at least twice that of the channel of the orifice the size.

3. A pump according to claim 2, wherein the outlet valve member has a maximum effective cross-sectional area not less than one-fourth that of the piston in the pump body.

4. A pump according to claim 1, wherein the annular seat is a cup having a sidewall and a bottom, the bottom intersecting the axial orifice, said bottom connected via a rounded fillet to an outwardly sloping ring, said fillet and ring defining said sidewall; the outlet valve member being bell-shaped with a downwardly-turned distal lip that is thin, the perimeter length of which lip in the relaxed state is substantially equal to or slightly greater than that of the fillet; the outlet valve member lip bearing against and being sealingly compressed and applied onto the sidewall and bottom under the force of the return spring of the outlet valve member.

5. A pump according to claim 4, wherein the lip of the outlet valve member has limited resilience that allows it to follow the outwardly sloping widened ring only over a distance less than the total height of the ring between a lower sealing position and a higher non-sealing position.

6. A pump according to claim 5, wherein the height of the cup sidewall is a few tenths of a millimeter, and the average slope of the ring is about 0.3.

7. A pump according to claim 6, wherein the slope of the sidewall ring increases from its intersection with the fillet towards the top, so as to provide an S-shape to the sidewall.

8. A pump according to claim 6, wherein the distal edge of the lip has a curvature greater than that of said fillet.

9. A pump according to claim 8, wherein the bottom of the cup has an inwardly converging conical shape as it approaches the axial orifice.

* * * * *